US009725969B2

(12) United States Patent
Nguyen et al.

(10) Patent No.: US 9,725,969 B2
(45) Date of Patent: Aug. 8, 2017

(54) POSITIVE LOCK SYSTEM

(71) Applicant: Cameron International Corporation, Houston, TX (US)

(72) Inventors: Dennis P. Nguyen, Pearland, TX (US); Maria R. Contreras, Houston, TX (US)

(73) Assignee: Cameron International Corporation, Houston, TX (US)

( * ) Notice: Subject to any disclaimer, the term of this patent is extended or adjusted under 35 U.S.C. 154(b) by 408 days.

(21) Appl. No.: 14/326,223

(22) Filed: Jul. 8, 2014

(65) Prior Publication Data

US 2016/0010404 A1 Jan. 14, 2016

(51) Int. Cl.
*E21B 33/04* (2006.01)
*E21B 19/10* (2006.01)

(52) U.S. Cl.
CPC ..... *E21B 19/10* (2013.01); *E21B 33/04* (2013.01); *E21B 33/0422* (2013.01)

(58) Field of Classification Search
CPC ..... E21B 33/04; E21B 33/0422
See application file for complete search history.

(56) References Cited

U.S. PATENT DOCUMENTS 2,358,677 A 9/1944 Yancey
2,582,700 A * 1/1952 Jones ..... E21B 43/101 166/137
3,115,933 A * 12/1963 Haeber ..... E21B 33/035 166/340
3,209,829 A * 10/1965 Haeber ..... E21B 33/035 166/348
3,250,331 A 5/1966 Boyle
3,287,030 A * 11/1966 Crain ..... E21B 33/035 166/208
3,351,133 A 11/1967 Clark, Jr. et al.
3,376,935 A 4/1968 Baker
3,385,370 A 5/1968 Knox et al.
3,542,125 A * 11/1970 Sizer ..... E21B 23/002 166/340
3,913,670 A 10/1975 Ahlstone
3,924,679 A 12/1975 Jansen, Jr.
3,933,202 A 1/1976 Ahlstone
4,058,162 A 11/1977 Smith
4,121,660 A 10/1978 Koleilat
4,381,868 A 5/1983 Croy et al.
4,657,083 A 4/1987 Ringgenberg
(Continued)

FOREIGN PATENT DOCUMENTS

EP 0370744 A1 5/1990
GB 2291449 A 1/1996
(Continued)

OTHER PUBLICATIONS

PCT Invitation to Pay Additional Fees; Application No. PCT/US2015/039601; Dated Nov. 30, 2015; 6 pages.
(Continued)

*Primary Examiner* — Shane Bomar
(74) *Attorney, Agent, or Firm* — Fletcher Yoder, P.C.

(57) ABSTRACT

A system including a positive lock system, including a lock ring system, including a load ring configured to engage a tubular, and a lock ring configured to radially energize the load ring by moving only in an axial direction.

23 Claims, 9 Drawing Sheets

(56) References Cited

U.S. PATENT DOCUMENTS

| | | | | |
|---|---|---|---|---|
| 4,667,986 | A | 5/1987 | Johnson et al. | |
| 4,736,799 | A | 4/1988 | Ahlstone | |
| 4,790,379 | A * | 12/1988 | Vanderford, Jr. | E21B 33/0422 166/208 |
| 4,825,945 | A | 5/1989 | Smith | |
| 4,848,469 | A | 7/1989 | Baugh et al. | |
| 5,013,187 | A * | 5/1991 | MacIntyre | E21B 33/04 166/348 |
| 5,114,158 | A * | 5/1992 | Le | E21B 33/03 166/387 |
| 5,320,181 | A | 6/1994 | Lantier, Sr. et al. | |
| 5,456,321 | A * | 10/1995 | Shiach | E21B 33/04 166/382 |
| 5,511,617 | A | 4/1996 | Snider et al. | |
| 5,782,297 | A | 7/1998 | Samuels et al. | |
| 5,909,769 | A | 6/1999 | Duhon et al. | |
| 5,996,695 | A | 12/1999 | Koleilat et al. | |
| 6,260,850 | B1 | 7/2001 | Beall et al. | |
| 6,283,477 | B1 | 9/2001 | Beall et al. | |
| 6,349,771 | B1 | 2/2002 | Luke | |
| 6,497,291 | B1 | 12/2002 | Szarka | |
| 6,585,048 | B1 | 7/2003 | Heijnen | |
| 6,622,795 | B2 | 9/2003 | Hebert et al. | |
| 6,834,726 | B2 | 12/2004 | Giroux et al. | |
| 6,969,070 | B2 | 11/2005 | Reimert et al. | |
| 6,988,556 | B2 | 1/2006 | Vick, Jr. | |
| 7,069,987 | B2 | 7/2006 | Kwasniewski et al. | |
| 7,111,688 | B2 | 9/2006 | Van Bilderbeek | |
| 7,128,143 | B2 | 10/2006 | Van Bilderbeek | |
| 7,137,453 | B2 | 11/2006 | Gustafson et al. | |
| 7,240,735 | B2 * | 7/2007 | Crozier | E21B 33/047 166/242.6 |
| 7,308,934 | B2 | 12/2007 | Swagerty et al. | |
| 7,527,104 | B2 | 5/2009 | Branch et al. | |
| 2002/0023758 | A1 | 2/2002 | George et al. | |
| 2006/0108119 | A1 | 5/2006 | Bailey et al. | |
| 2007/0079990 | A1 | 4/2007 | Borak | |
| 2009/0090515 | A1 | 4/2009 | Chan et al. | |
| 2010/0051261 | A1 | 3/2010 | Koleilat et al. | |
| 2010/0193195 | A1 * | 8/2010 | Nguyen | E21B 33/04 166/338 |
| 2010/0258319 | A1 * | 10/2010 | Nguyen | E21B 23/02 166/373 |
| 2011/0011575 | A1 * | 1/2011 | Nguyen | E21B 23/01 166/87.1 |

FOREIGN PATENT DOCUMENTS

| | | | |
|---|---|---|---|
| GB | 2408989 | A | 6/2005 |
| WO | 02/38913 | A1 | 5/2002 |
| WO | 2009/014795 | A2 | 1/2009 |

OTHER PUBLICATIONS

PCT International Search Report and Written Opinion; Application No. PCT/US2015/039601; Dated Feb. 8, 2016; 16 pages.

* cited by examiner

POSITIVE LOCK SYSTEM

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In some drilling and production systems, hangers, such as a tubing hanger, may be used to suspend strings of tubing for various flows in and out of the well. Such hangers may be disposed within a wellhead that supports both the hanger and the string. For example, a tubing hanger may be lowered into a wellhead and supported therein. To facilitate the running or lowering process, the tubing hanger may couple to a tubing hanger running tool (THRT). Once the tubing hanger has been lowered into a landed position within the wellhead by the THRT, the tubing hanger may then be rotatably locked into position. The THRT may then be disconnected from the tubing hanger and extracted from the wellhead. Unfortunately, existing systems used to rotatably lock a tubing hanger in place may be complicated and time consuming. Moreover, rotation of the tubing hanger may reduce the effectiveness of seals between the tubing hanger and the Christmas tree.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments include a positive lock system and seal assembly system that may be installed without rotation or other complicated and time-consuming processes. As will be explained in detail below, the positive lock system may include a lock ring system and a tool. In operation, the tool may axially energize the seal assembly to form a seal between a first tubular and a second tubular, and then the tool locks/holds the seal assembly in place with the lock ring system. The lock ring system may include a load ring that couples to a first tubular and a lock ring that prevents the load ring from uncoupling from the first tubular. During installation, the tool axially engages the lock ring to drive the lock ring into contact with the load ring. The contact between the load ring and the lock ring forces the load ring radially outward or inward as the lock ring contacts the load ring. In this manner, a simple axial motion couples the load ring to a tubular while simultaneously locking the load ring in place. In some embodiments, the lock or load ring may include protrusions that increase pressurized contact between the lock ring and the load ring to resist axial movement of the lock ring.

Figure 1:
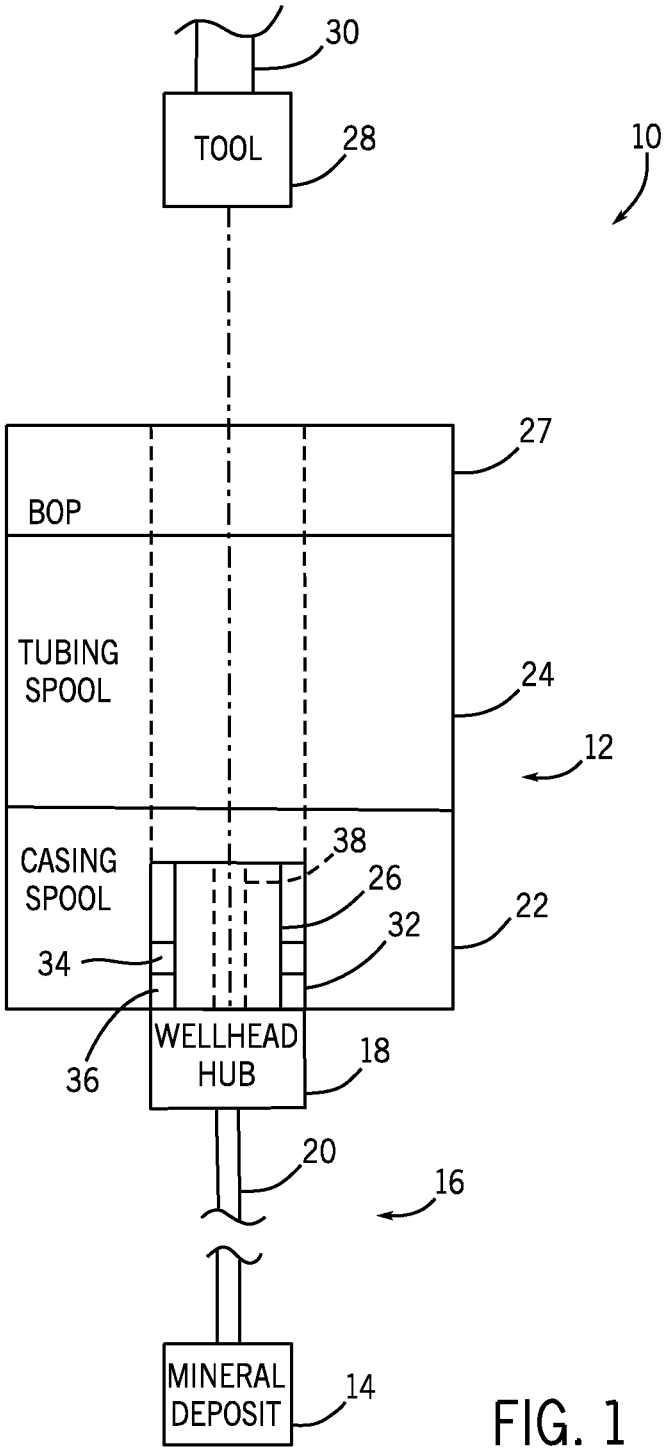
FIG. 1 is a block diagram of an embodiment of a mineral extraction system.

FIG. 1 is a block diagram that illustrates a mineral extraction system 10 according to an embodiment. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a wellhead hub 18 and a well-bore 20.

The wellhead hub 18 generally includes a large diameter hub that is disposed at the termination of the well-bore 20. The wellhead hub 18 provides for the connection of the wellhead 12 to the well 16. The wellhead 12 typically includes multiple components that control and regulate activities and conditions associated with the well 16. In the illustrated embodiment, the wellhead 12 includes a casing spool 22, a tubing spool 24, a hanger 26 (e.g., a tubing hanger or a casing hanger), and a blowout preventer (BOP) 27. However, the system 10 may include other devices that are coupled to the wellhead 12, and devices that are used to assemble and control various components of the wellhead 12. For example, in the illustrated embodiment, the system 10 includes a tool 28 suspended from a drill string 30. In certain embodiments, the tool 28 includes a running tool and/or a hydraulic locking tool that is lowered (e.g., run) from an offshore vessel to the well 16 and/or the wellhead 12.

In operation, wellhead 12 enables completion and workover procedures, such as the insertion of tools (e.g., the hanger 26) into the well 16 and the injection of various chemicals into the well 16. Further, minerals extracted from the well 16 (e.g., oil and natural gas) may be regulated and routed via the wellhead 12. A blowout preventer (BOP) 27 may also be included, either as a part of the wellhead 12 or as a separate device. The BOP 27 may consist of a variety of valves, fittings and controls to prevent oil, gas, or other fluid from exiting the well 16 in the event of an unintentional release of pressure or an overpressure condition.

As illustrated, the casing spool 22 defines a bore 32 that enables fluid communication between the wellhead 12 and the well 16. Thus, the casing spool bore 34 may provide access to the well bore 20 for various completion and workover procedures. For example, the tubing hanger 26 can be run down to the wellhead 12 and disposed in the casing spool bore 32. In operation, the hanger 26 (e.g., tubing hanger or casing hanger) provides a path (e.g., hanger bore 38) for hydraulic control fluid, chemical injections, etc. As illustrated, the hanger bore 38 extends through the center of the hanger 26 enabling fluid communication with the tubing spool bore 32 and the well bore 20. As will be appreciated, the well bore 20 may contain elevated pressures. Accordingly, mineral extraction systems 10 employ various mechanisms, such as seals, plugs, and valves, to control and regulate the well 16. For example, the mineral extraction system 10 may include a sealing assembly 34 (e.g., annular seal assembly) in a space 36 (e.g., annular region) between the tubing hanger 26 and the casing spool 22 that blocks fluid flow through the space 36.

Figure 2:
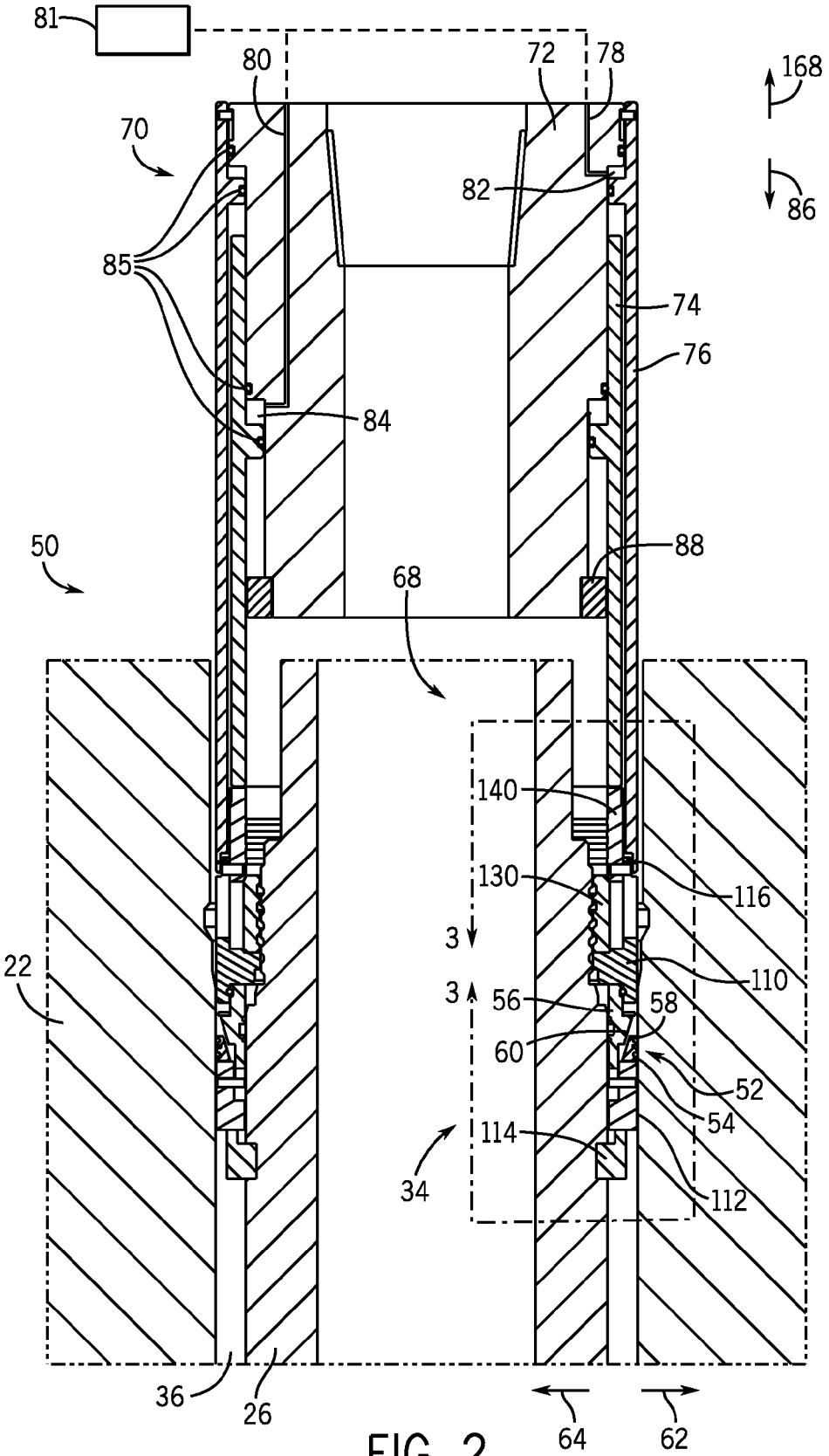
FIG. 2 is a cross-sectional side view of an embodiment of a positive lock system and an unenergized seal assembly.

FIG. 2 is a cross-sectional side view of an embodiment of a positive lock system 50 capable of energizing and locking the seal assembly 34 without rotation. As explained above, the mineral extraction system 10 may include various seals, plugs, etc. that control the flow of fluid into and out of the well 16. For example, the mineral extraction system 10 may include the seal assembly 34 that forms a seal in the space 36 between the tubing hanger 26 and the casing spool 22. The seal assembly 34 may form the seal with a metal-to-metal seal 52 (e.g., annular seal) that circumferentially surrounds the tubing hanger 26. The metal-to-metal seal 52 may include a first metal seal portion 54 (e.g., tapered annular seal portion) and a second metal seal portion 56 (e.g., tapered annular seal portion) with corresponding angled faces 58 and 60. In operation, the first angled face 58 and the second angled face 60 slide past each other forcing the first metal seal portion 54 and the second metal seal portion 56 radially outward in respective directions 62 and 64 to form a seal between the casing spool 22 and the tubing hanger 26. The seal formed by the metal-to-metal seal 52 is then held (e.g., locked) in place using the positive lock system 50.

The positive lock system 50 may include a lock ring system 68 and a tool 70 (e.g., a hydraulic tool). In operation, the tool 70 engages and energizes the seal assembly 34 and the lock ring system 68 without rotating or other complicated and time-consuming processes. The tool 70 includes a hydraulic body 72 surrounded by an inner annular piston cylinder 74 and an outer annular piston cylinder 76. The inner and outer annular piston cylinders 74 and 76 operate independently to axially actuate the lock ring system 68 and the seal assembly 34. More specifically, as hydraulic fluid enters the hydraulic body 72, from a hydraulic fluid source 81, the fluid passes through hydraulic fluid lines 78 and 80 (e.g., internal lines) and into respective hydraulic chambers 82 and 84 (e.g., annular hydraulic chambers). The hydraulic 82 and 84 are formed between the inner and outer annular piston cylinders 74 and 76 and sealed with o-rings 85. As the hydraulic fluid fills the hydraulic chambers 82 and 84, the hydraulic fluid forces the inner and outer annular piston cylinders 74 and 76 in axial direction 86 to engage the respective lock ring system 68 and the seal assembly 34. In some embodiments, the tool 70 may include a ring 88 that enables attachment of the inner and outer annular piston cylinders 74 and 76 to the hydraulic body 72 during assembly, but blocks separation of the inner and outer annular piston cylinders 74 and 76 once attached.

Figure 3:
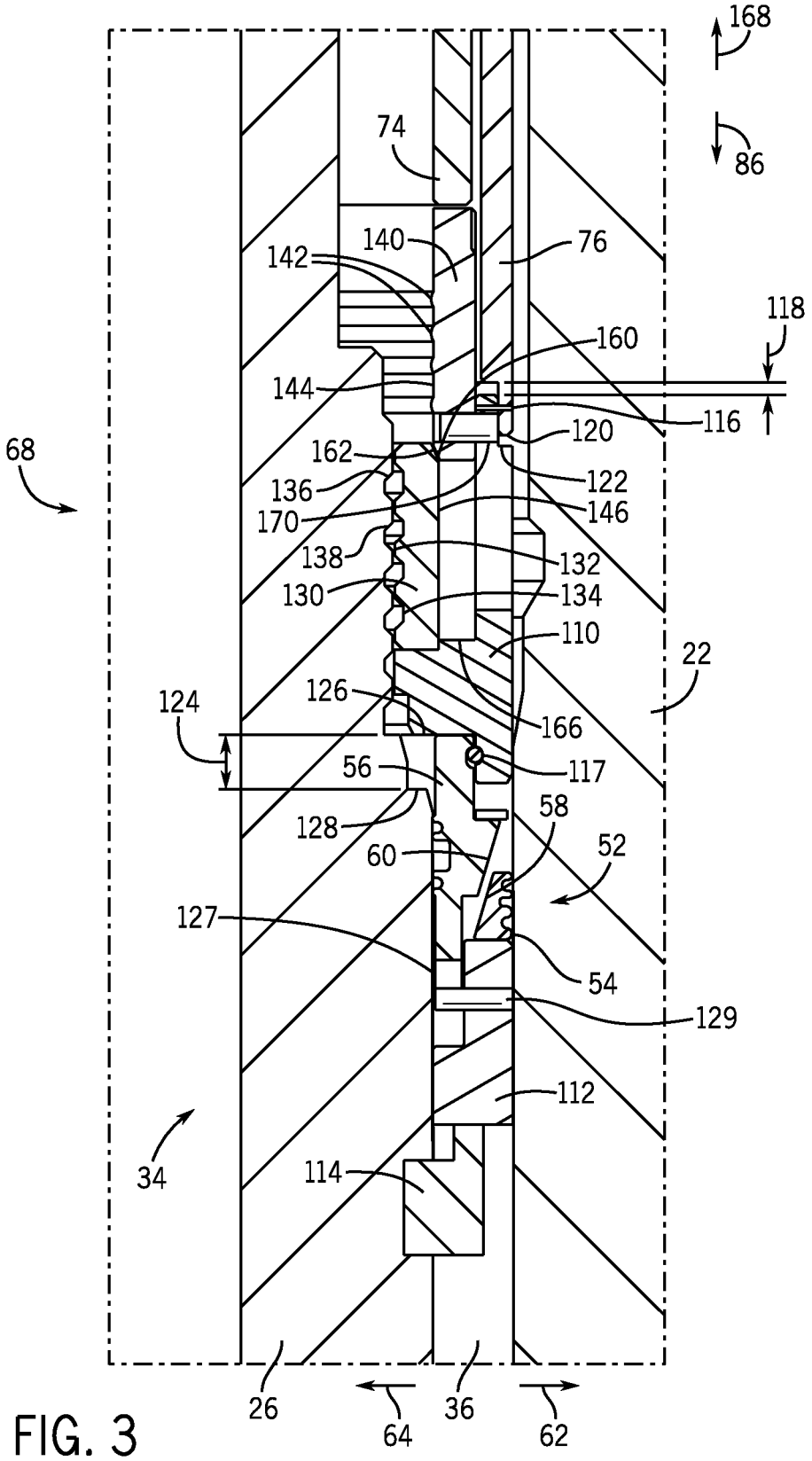
FIG. 3 is a detail view of an embodiment of the positive lock system and the unenergized seal assembly within lines 3-3 of FIG. 2.

FIG. 3 is a detail view of FIG. 2 within line 3-3 illustrating an embodiment of the lock ring system 68 in an unlocked position and the seal assembly 34 in an unenergized state. In some embodiments, the seal assembly 34 may include a first seal sleeve 110, a second seal sleeve 112, and the metal-to-metal seal 52. As illustrated, the outer hydraulic annular piston cylinder 76 couples to the first seal sleeve 110 with a sheer pin 116 and the first seal sleeve 110 couples to the metal-to-metal seal 52 with a ring 117, enabling the tool 70 to deliver the seal assembly 34 and the lock ring system 68 to the correct position within the mineral extraction system 10. In operation, the tool 70 lowers the seal assembly 34 until the second seal sleeve 112 contacts a seal landing 114 coupled to the tubing hanger 26. In some embodiments, the seal landing 114 may couple to the casing spool 22, the tubing hanger 26, or another tubular to provide support for the seal assembly 34. After lowering the seal assembly 34 and the lock ring system 68, the tool 70 activates the outer hydraulic annular piston cylinder 76 driving the outer hydraulic annular piston cylinder 76 an axial distance 118. As the outer hydraulic annular piston cylinder 76 moves the axial distance 118, the outer hydraulic annular piston cylinder 76 shears through the shear pin 116, enabling the lower surface 120 of the outer hydraulic annular piston cylinder 76 to contact the upper surface 122 of the first seal sleeve 110. Once in contact, the outer hydraulic annular piston cylinder 76 drives the first seal sleeve 110 in axial direction 86 an axial distance 124 until a lip 126 (e.g., annular lip) on the first seal sleeve 110 contacts a ledge 128 (e.g., annular ledge) of the tubing hanger 26. The movement of the first seal sleeve 110 forces the second angled face 60 of the second metal seal portion 56 to contact and slide past the first angled face 58 of the first metal seal portion 54. In some embodiments, the second metal seal portion 56 may have a slot 127 that receives a pin 129 that extends from the second seal sleeve 112. In operation, the pin 129 couples the second seal sleeve 112 to the seal assembly 34 and maintains alignment of the second metal seal portion 56 as the second metal seal portion moves axially. As the first and second angled faces 58 and 60 slide past each other, the first and second metal seal portions 54 and 56 are forced radially outward in opposite directions 62 and 64 forming a seal between the casing spool 22 and the tubing hanger 26. Moreover, as the first seal sleeve 110 moves in axial direction 86, the first seal sleeve 110 aligns the load ring 130 with the tubing hanger 26. For example, the load ring 130 may include multiple protrusions 132 (e.g., axially spaced annular protrusions or teeth) on a surface 134 that correspond to recesses 136 (e.g., axially spaced annular recesses) on a surface 138 of the tubing hanger 26. Accordingly, movement of the first seal sleeve 110 in axial direction 86 enables the protrusions 132 to align with the recesses 134 while simultaneously energizing the seal assembly 34.

In order to maintain the seal formed by the metal-to-metal seal 52, the inner hydraulic annular piston cylinder 74 drives the lock ring system 68 into a locked position without rotation. The lock ring system 68 includes the load ring 130 and a lock ring 140. In operation, the load ring 130 couples to the tubing hanger 26 in order to resist movement of the seal assembly 34. Specifically, the multiple protrusions 132 on the surface 134 resist axial movement after engaging the recesses 136 on surface 138 of the tubing hanger 26. In order to maintain engagement between the load ring 130 and the tubing hanger 26, the hydraulic tool 70 axially drives the lock ring 140 behind the load ring 130. In some embodiments, the lock ring 140 may include protrusions 142 (e.g., axially spaced annular protrusions or teeth) on a surface 144 that may remove a gap between the surface 144 and 146 as well as increase pressurized contact between the lock ring 140 and the load ring 130 to resist movement of the lock ring 140 in direction 86 or 168. In other embodiments, the load ring 130 may include the protrusions 142 on the surface 146 to increase pressurized contact between the lock ring 140 and the load ring 130.

Figure 4:
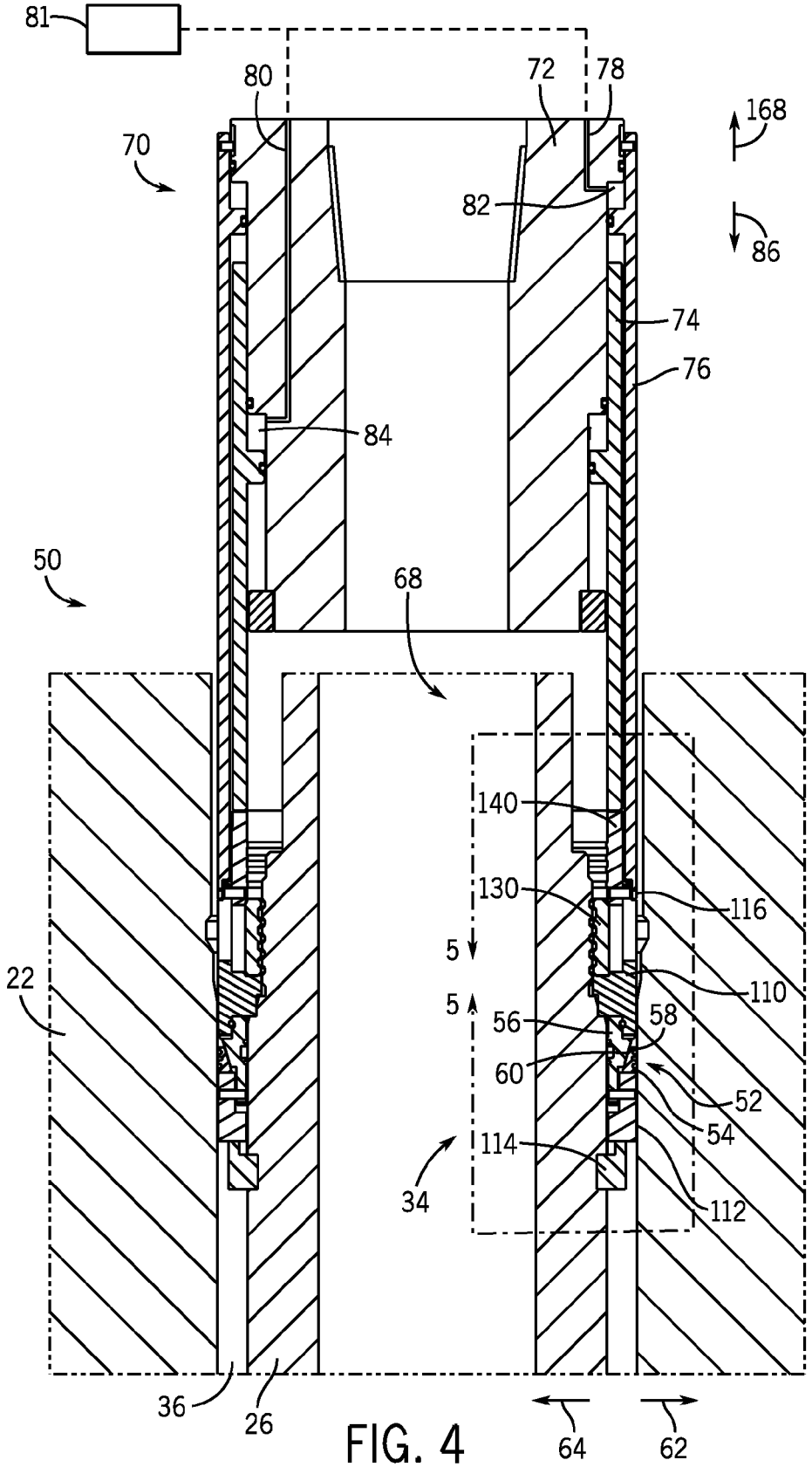
FIG. 4 is a cross-sectional side view of an embodiment of a positive lock system and an energized seal assembly.

FIG. 4 is a cross-sectional side view of the tool 70 energizing the seal assembly 34. In order to energize the seal assembly 34, the tool 70 pumps hydraulic fluid from an external source through the hydraulic line 78 and into the hydraulic chamber 82. As the hydraulic fluid fills the hydraulic chamber 82, the pressure of the fluid drives the outer hydraulic annular piston cylinder 76 axially downward in direction 86. The movement of the outer hydraulic annular piston cylinder 76 in direction 86 enables the outer hydraulic annular piston cylinder 76 to contact and energize the seal assembly 34.

Figure 5:
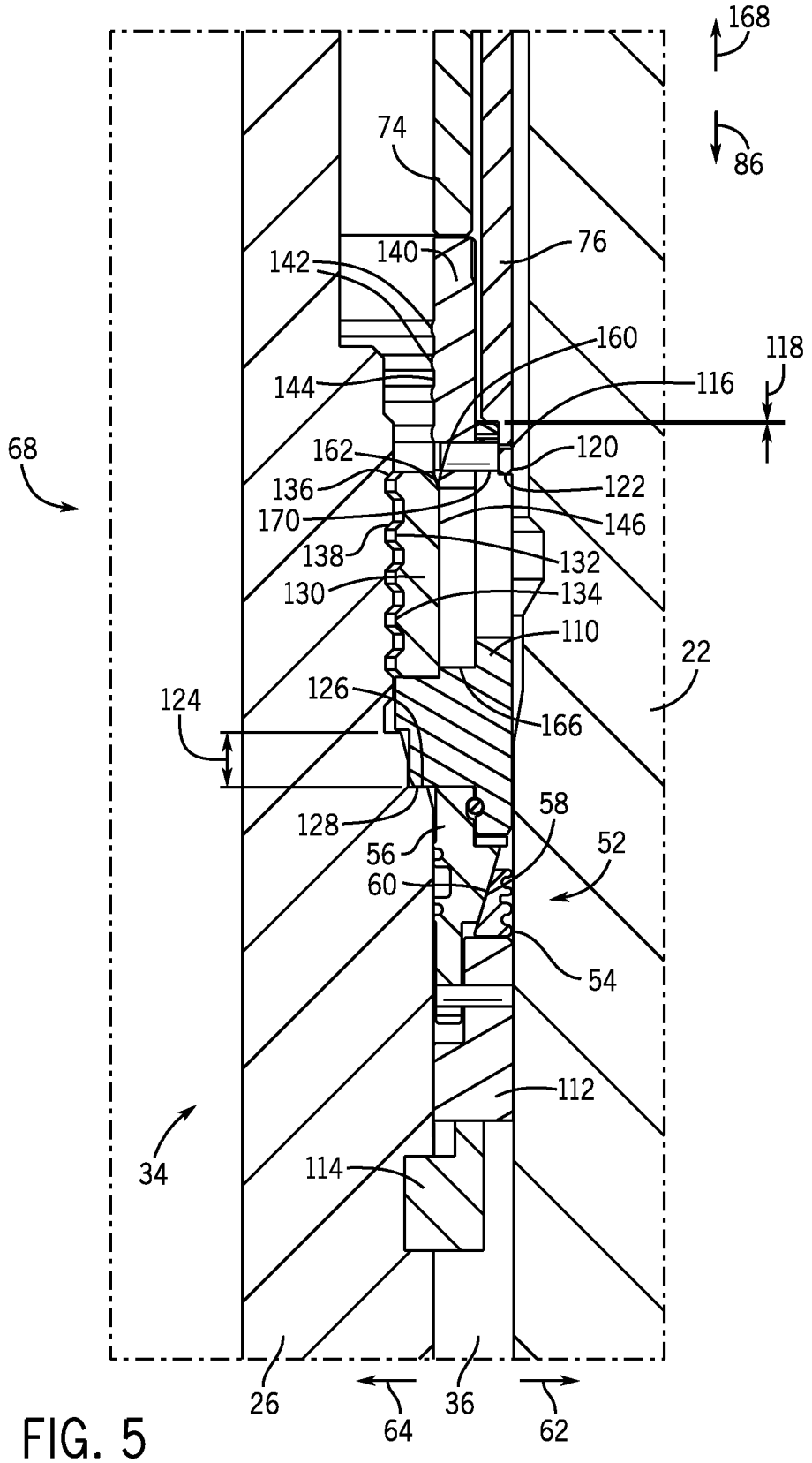
FIG. 5 is a detail view of an embodiment of the positive lock system and the energized seal assembly within lines 5-5 of FIG. 4.

FIG. 5 is a detail view of FIG. 4 within line 5-5 illustrating the seal assembly 34 in an energized state. As explained above, the tool 70 activates the outer hydraulic annular piston cylinder 76 axially driving the outer hydraulic annular piston cylinder 76 a distance 118 to shear through the shear pin 116. After shearing through the shear pin 116, the lower surface 120 of the outer hydraulic annular piston cylinder 76 contacts the upper surface 122 of the first seal sleeve 110. Once in contact, the outer hydraulic annular piston cylinder 76 drives the first seal sleeve 110 in direction 86 the distance 124 until the lip 126 contacts the ledge 128 of the tubing hanger 26. As the first seal sleeve 110 moves in direction 86, the first seal sleeve 110 contacts and drives the second metal seal portion 56 against the first metal seal portion 54. The contact between the first and second metal seal portions 54 and 56 enables the first and second angled faces 58 and 60 to slide past each forcing the first and second metal seal portions 54 and 56 radially outward in directions 62 and 64 forming a seal. Furthermore, as the first seal sleeve 110 moves in direction 86, the first seal sleeve 110 enables the load ring 130 to align with the tubing hanger 26. As explained above, the load ring 130 may include multiple protrusions 132 that enable the load ring 130 to couple (e.g., lock) to the tubing hanger 26. Accordingly, as the first seal sleeve 110 moves in axial direction 86 the protrusions 132 on the load ring 130 align with the recesses 136 on the hanger 26.

Figure 6:
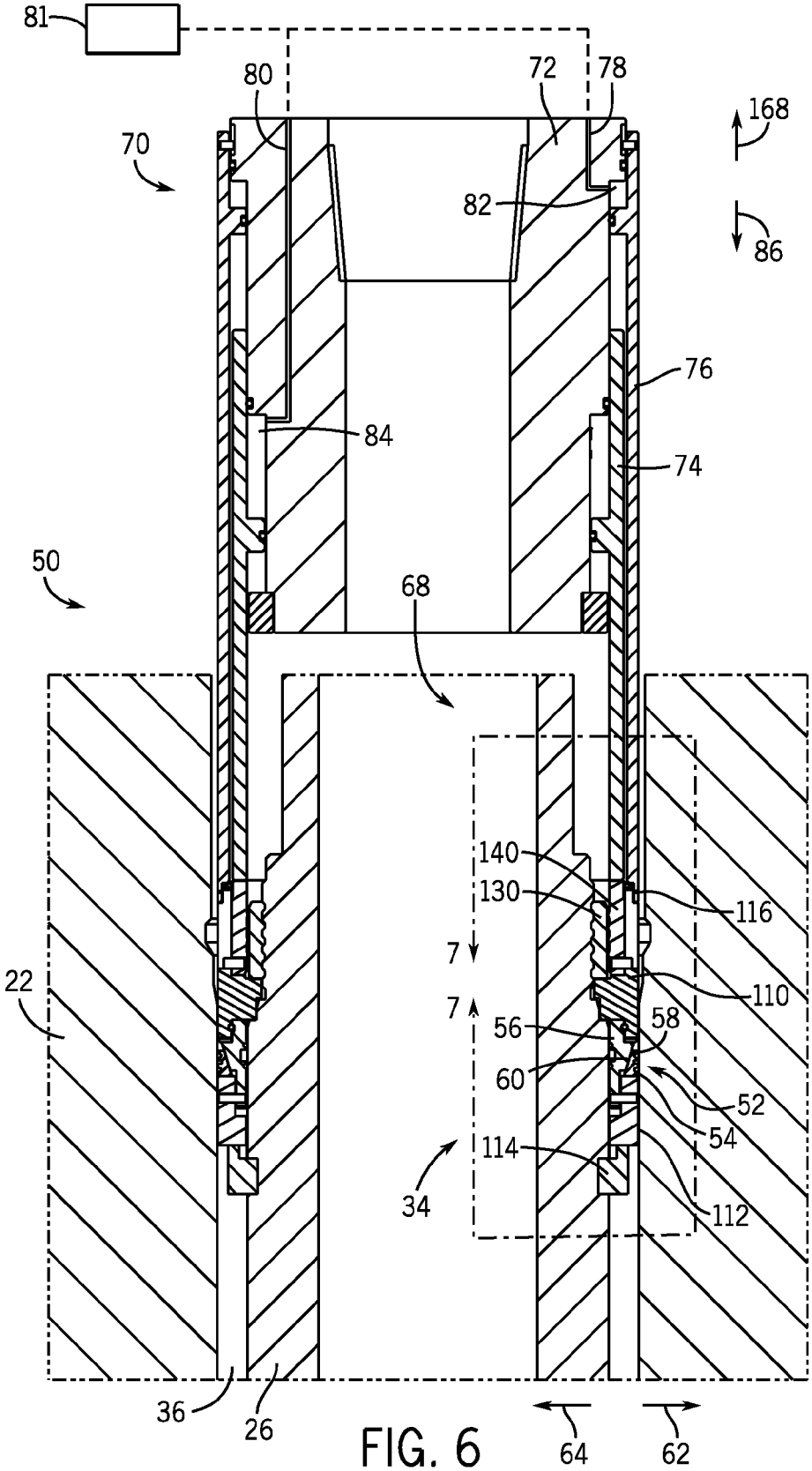
FIG. 6 is a cross-sectional side view of an embodiment of a positive lock system in a locked position.

FIG. 6 is a cross-sectional view of an embodiment of an energized lock ring system 68. In order to energize the lock ring system 68, the tool 70 pumps hydraulic fluid from an external source through the hydraulic line 80 and into the hydraulic chamber 84. As the hydraulic fluid fills the hydraulic chamber 84, the pressure of the hydraulic fluid drives the inner hydraulic annular piston cylinder 74 axially downward in direction 86. The vertical movement of the inner hydraulic annular piston cylinder 74 in direction 86 enables the tool 70 to energize the lock ring system 68, which maintains the seal formed by the seal assembly 34.

Figure 7:
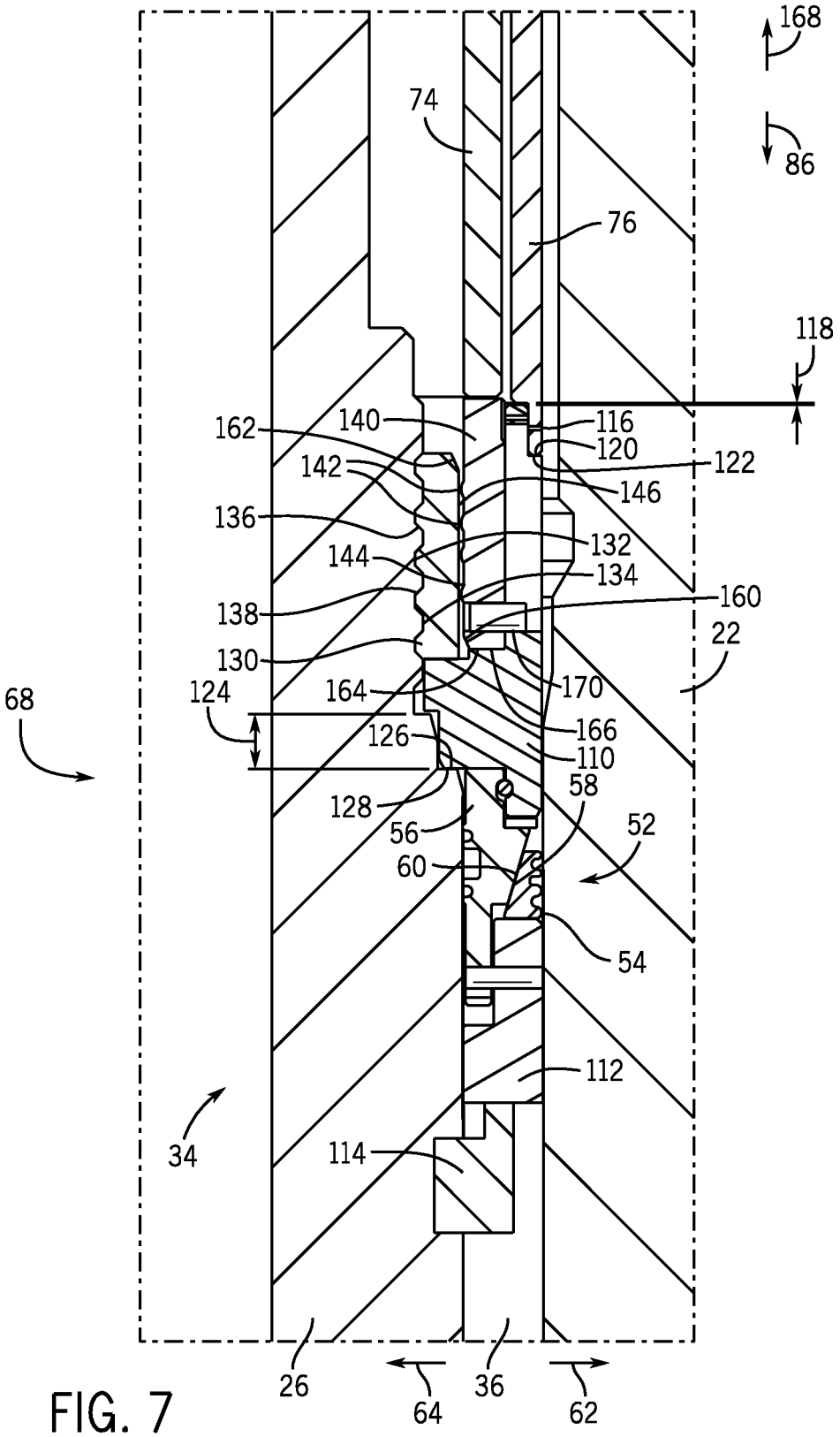
FIG. 7 is a detail view of an embodiment of the positive lock system in the locked position within lines 7-7 of FIG. 6.

FIG. 7 is a detail view of FIG. 6 within line 7-7 of an embodiment of the energized lock ring system 68. As explained above, the lock ring system 68 includes the load ring 130 and the lock ring 140. In operation, the load ring 130 couples to the tubing hanger 26 in order to resist movement of the seal assembly 34. In order to maintain engagement between the load ring 130 and the tubing hanger 26, the hydraulic tool 70 drives inner hydraulic annular piston cylinder 74 in substantially direction 86, which moves the lock ring 140 circumferentially behind the load ring 130. More specifically, as the lock ring 140 moves in substantially direction 86 an angled contact surface 160 on the lock ring 140 contacts a corresponding angled surface 162 on the load ring 130. The contact between the two angled surfaces 160 and 162 forces the load ring 130 radially inward, coupling the load ring 130 to the hanger 26. As explained above, the load ring 130 may couple to the tubing hanger 26 with multiple protrusions 132 on the surface 134 that correspond to recesses 136 on the surface 138 of the tubing hanger 26. After coupling the load ring 130 to the tubing hanger 26, the inner hydraulic annular piston cylinder 74 will continue driving the lock ring 140 in axial direction 86 until the bottom surface 164 of the lock ring 140 contacts a top surface 166 of the first seal sleeve 110. In this position, the lock ring 140 blocks radial movement of the load ring 130, while the protrusions 132 on the load ring block/resist axial movement in direction 168, which maintains the seal assembly 34 in a sealed position. In some embodiments, a guide pin 170 may couple the lock ring 140 to the first seal sleeve 110. In operation, the guide pin 170 couples the lock ring system 68 to the seal assembly 34 during insertion, and maintains alignment (e.g., axially guides) of the lock ring 140 as the inner hydraulic annular piston cylinder 74 axially drives the lock ring 140. Furthermore, in some embodiments, the lock ring 140 may include protrusions 142 on the surface 144. These protrusions may increase pressurized contact between the lock ring 140 and the load ring 130 to resist axial movement of the lock ring 140 in direction 168.

Figure 8:
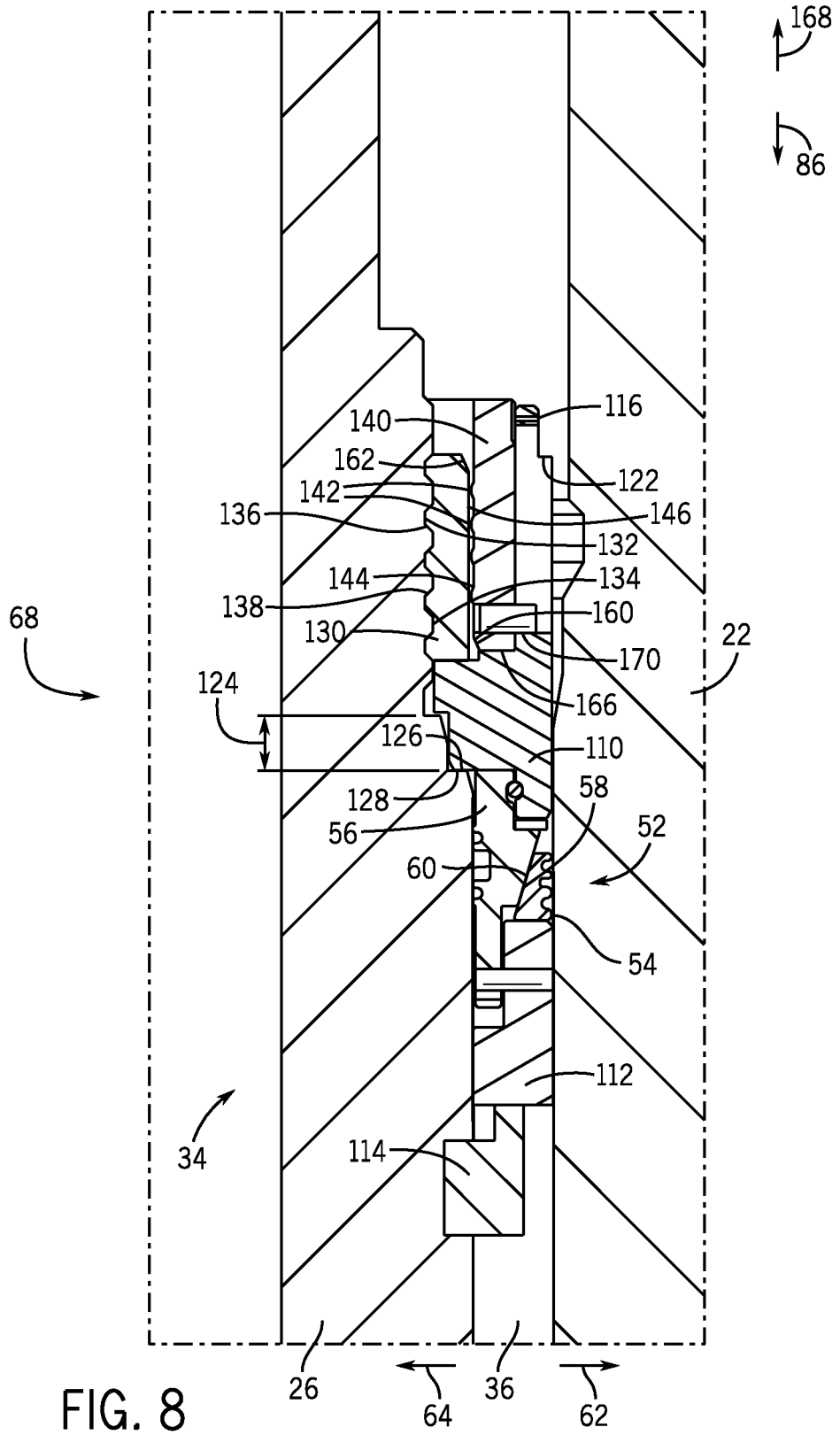
FIG. 8 is a cross-sectional side view of an embodiment of a lock ring system and a seal assembly.

FIG. 8 is a cross-sectional view of an embodiment of the positive lock system 68 and the seal assembly 34 in an energized state. As illustrated, the tool 70 may be withdrawn after forming a seal with the seal assembly 34 and locking the seal assembly 34 in place with the lock ring system 68. Indeed, after energizing the lock ring system 68 and the seal assembly 34, the hydraulic tool 70 may be axially withdrawn in direction 168 without rotation or other complicated procedures. As explained above, the positive lock system 50 lowers, activates, and retains the seal assembly 34 without rotation or other complicated time consuming processes.

Figure 9:
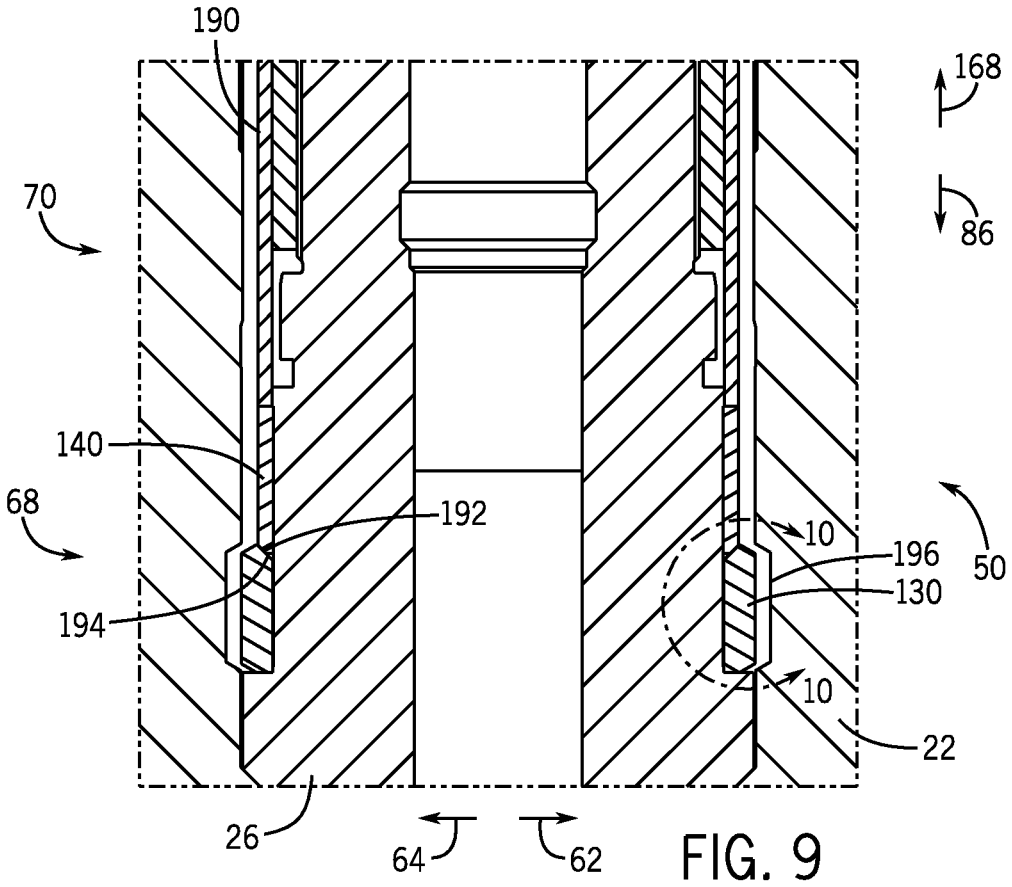
FIG. 9 is a cross-sectional side view of an embodiment of a lock ring system in an unlocked position.

FIG. 9 is a cross-sectional view of an embodiment of a lock ring system 68 capable of locking a tubing hanger 26 within a casing spool 22 using only axial motion from a tool 70. The lock ring system 68 includes a load ring 130 and a lock ring 140. In order to energize the lock ring system 68, the tool 70 pumps hydraulic fluid from an external source to drive a hydraulic piston cylinder 190 axially downward in direction 86. As the hydraulic piston cylinder 190 moves axially in direction 86, the hydraulic piston cylinder 190 contacts the lock ring 140 moving the lock ring 190 in substantially axial direction 86. The downward movement of the lock ring 140 enables an angled contact surface 192 on the lock ring 140 to contact a corresponding angled surface 194 on the load ring 130. The contact between the two angled surface 192 and 194 forces the load ring 130 radially outward in directions 64 and 62 and into a recess 196 on the casing spool 22. Accordingly, the axial movement of the outer hydraulic annular piston cylinder 76 and the lock ring 140 enables the lock ring system 68 to energize and lock the tubing hanger 26 to the casing spool 22 without rotation.

Figure 10:
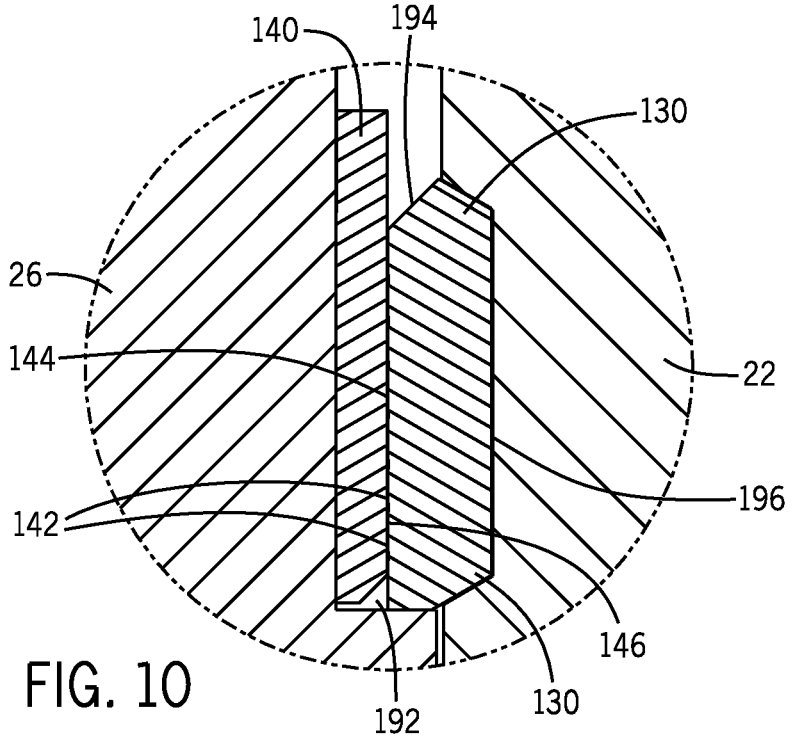
FIG. 10 is a detail view of an embodiment of the lock ring system in a locked position within lines 10-10 of FIG. 9.

FIG. 10 is a detail view within line 10-10 of FIG. 9 of an embodiment of the lock ring system 68 in a locked or energized position. As illustrated, the load ring 130 is forced circumferentially into the groove 196 by the lock ring 140. In some embodiments, the lock ring 140 may include the protrusions 142 on the surface 144 and/or the load ring 130 may include protrusions 142 on surface 146. These protrusions 142 may remove a gap between the surfaces 144 and 146 as well as increase pressurized contact between the lock ring 140 and the load ring 130, which resists axial movement of the lock ring 140 in direction 86 or 168. Accordingly, the positive lock system 50 lowers, activates, and retains the tubing hanger 26 without rotation or other complicated time consuming processes.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a positive lock system configured to energize a seal assembly in response to a first axial movement of a first piston, wherein the positive lock system comprises:

a lock ring system, comprising:

a load ring configured to engage a tubular; and a lock ring configured to radially energize the load ring by moving only in an axial direction in response to a second axial movement of a second piston after the first axial movement of the first piston.

2. The system of claim 1, wherein the load ring comprises a plurality of radial teeth configured to engage the tubular.

3. The system of claim 1, wherein the lock ring comprises a plurality of radial protrusions configured to increase a contact pressure between the load ring and the lock ring in a locked position.

4. The system of claim 1, comprising a guide pin configured to axially guide the lock ring.

5. The system of claim 1, wherein the lock ring is configured to move in the axial direction from a first axial position to a second axial position, the lock ring and the load ring axially overlap with one another in the second position, the load ring is disposed in a first radial position in the first axial position of the lock ring, and the load ring is disposed in a second radial position in the second axial position of the lock ring.

6. The system of claim 1, wherein the lock ring is configured to move in the axial direction to surround the load ring and drive the load ring radially inward.

7. The system of claim 1, wherein the lock ring is configured to move in the axial direction to be surrounded by the load ring and drive the load ring radially outward.

8. The system of claim 1, comprising a tool having the first and second pistons, wherein the tool is retrievable after energizing the seal assembly and the lock ring system.

9. The system of claim 8, wherein the tool comprises a hydraulic body, the first piston is configured to undergo the first axial movement in response to a first hydraulic fluid to energize the seal assembly, and the second piston is configured to undergo the second axial movement in response to a second hydraulic fluid to energize the lock ring system.

10. The system of claim 1, wherein the first piston is configured to undergo the first axial movement to energize the seal assembly after shearing through a shear pin.

11. The system of claim 1, wherein the first piston is configured to undergo the first axial movement to energize the seal assembly and align the lock ring system at an axial position relative to the tubular.

12. A system, comprising:

a positive lock system, comprising:

a hydraulic tool configured to energize a seal assembly and a lock ring system one after another, wherein the hydraulic tool comprises:

a hydraulic body configured to couple to a hydraulic fluid source;

a first piston coupled to the hydraulic body; and a second piston coupled to the hydraulic body, wherein the first piston is configured to move axially with respect to the hydraulic body and the second piston to energize the seal assembly and align the lock ring system at an axial position between first and second tubulars, and the second piston is configured to move axially with respect to the hydraulic body and the first piston to energize the lock ring system at the axial position between the first and second tubulars after the first piston energizes the seal assembly.

13. The system of claim 12, wherein the first and second pistons are concentric annular pistons.

14. The system of claim 12, wherein the first tubular comprises a hanger of a mineral extraction system.

15. The system of claim 12, wherein the lock ring system comprises a load ring and a lock ring, and the hydraulic tool is configured to axially move the lock ring to energize the load ring via axial movement of the second piston.

16. A system, comprising:

a seal assembly configured to seal a space between a first tubular and a second tubular; and a positive lock system configured to energize the seal assembly in response to a first axial movement of a first piston, wherein the positive lock system comprises:

a lock ring system, comprising:

a load ring configured to engage the first tubular; and a lock ring configured to radially energize the load ring by moving only in an axial direction in response to a second axial movement of a second piston after the first axial movement of the first piston.

17. The system of claim 16, wherein the seal assembly comprises a metal-to-metal seal.

18. The system of claim 16, wherein the first tubular comprises a hanger of a mineral extraction system.

19. The system of claim 16, comprising a hydraulic tool having the first and second pistons, and the hydraulic tool is retrievable after the first piston energizes the seal assembly and the second piston energizes the lock ring system.

20. The system of claim 16, wherein the lock ring system is configured to hold the seal assembly in an energized state after the first piston energizes the seal assembly and the second piston energizes the lock ring system.

21. A method, comprising driving a first piston coupled to a hydraulic body of a hydraulic tool to undergo a first axial movement, relative to the hydraulic body and a second piston, to energize a seal assembly between first and second tubulars and align a lock ring system at an axial position between the first and second tubulars; and driving the second piston coupled to the hydraulic body of the hydraulic tool to undergo a second axial movement, relative to the hydraulic body and the first piston, to energize the lock ring system at the axial position and hold the seal assembly after the first piston energizes the seal assembly.

22. The method of claim 21, comprising retrieving the hydraulic tool having the first and second pistons after energizing the seal assembly and the lock ring system.

23. The method of claim 21, wherein driving the first piston comprises hydraulically driving the first piston, and driving the second piston comprises hydraulically driving the second piston.

* * * * *